US009140513B2

(12) United States Patent
Trpkovski

(10) Patent No.: US 9,140,513 B2
(45) Date of Patent: Sep. 22, 2015

(54) COMPACT COMPOUND BOW

(71) Applicant: PT Archery, Prairie Du Sac, WI (US)

(72) Inventor: Paul Trpkovski, Green Cove Springs, FL (US)

(73) Assignee: PT Archery, Prairie Du Sac, WI (US)

( * ) Notice: Subject to any disclaimer, the term of this patent is extended or adjusted under 35 U.S.C. 154(b) by 0 days.

(21) Appl. No.: 14/556,980

(22) Filed: Dec. 1, 2014

(65) Prior Publication Data

US 2015/0153131 A1 Jun. 4, 2015

Related U.S. Application Data

(60) Provisional application No. 61/910,930, filed on Dec. 2, 2013.

(51) Int. Cl.

| | |
|---|---|
| ***F41B 5/00*** | (2006.01) |
| ***F41B 5/10*** | (2006.01) |
| ***F41B 5/14*** | (2006.01) |

(52) U.S. Cl.

CPC ..... *F41B 5/10* (2013.01); *F41B 5/0031* (2013.01); *F41B 5/0094* (2013.01)

(58) Field of Classification Search

CPC ..... F41B 5/10; F41B 5/0031; F41B 5/0094
USPC ..... 124/23.1, 25.6, 86, 88, 89, 24.1
See application file for complete search history.

(56) References Cited

U.S. PATENT DOCUMENTS

| | | | | | |
|---|---|---|---|---|---|
| 1,526,176 | A | * | 2/1925 | O'Connell | 124/24.1 |
| 2,714,377 | A | * | 8/1955 | Jackson | 124/23.1 |
| 2,957,469 | A | * | 10/1960 | Wilkerson | 124/24.1 |
| 3,055,353 | A | * | 9/1962 | Perrucci | 124/24.1 |
| 3,238,935 | A | * | 3/1966 | Stanaland | 124/23.1 |
| 3,397,685 | A | * | 8/1968 | Walker | 124/88 |
| 3,561,418 | A | * | 2/1971 | Fredrickson | 124/24.1 |
| 3,834,368 | A | * | 9/1974 | Geiger | 124/20.3 |

(Continued)

FOREIGN PATENT DOCUMENTS

| | | |
|---|---|---|
| EP | 0515213 | 11/1992 |
| WO | 03006914 | 1/2003 |
| WO | 2015084840 | 6/2015 |

OTHER PUBLICATIONS

"Selected Pages from Apex Hunting web site regarding the Alien Triangle Bows", www.apexhunting.com.au Downloaded Jan. 6, 2015, 8 pages.

(Continued)

*Primary Examiner* — Melba Bumgarner
*Assistant Examiner* — Alexander Niconovich
(74) *Attorney, Agent, or Firm* — Pauly, DeVries Smith & Deffner, LLC

(57) ABSTRACT

Embodiments include a compact compound bow. In various embodiments, the compact compound bow includes a first riser plate and a second riser plate. The bow can further include a first limb and a second limb, the first limb and second limb can be coupled to the first riser plate and the second riser plate. The bow can further include a re-locatable handle configured to be coupled to at least one of the first riser plate or the second riser plate in a first position and coupled to at least one of the first riser plate or the second riser plate in a second position. The re-locatable handle can be rotated 180 degrees from the first position to the second position. Other embodiments are also included herein.

30 Claims, 11 Drawing Sheets

(56) References Cited

U.S. PATENT DOCUMENTS

| | | | | | |
|---|---|---|---|---|---|
| 3,923,036 | A | * | 12/1975 | Jennings et al. | 124/88 |
| 4,343,286 | A | * | 8/1982 | Thacker | 124/24.1 |
| 4,457,287 | A | * | 7/1984 | Babington | 124/23.1 |
| 4,662,344 | A | * | 5/1987 | Mitchell | 124/22 |
| 4,759,337 | A | * | 7/1988 | Suski | 124/24.1 |
| 4,957,094 | A | * | 9/1990 | Pickering et al. | 124/24.1 |
| 4,976,250 | A | * | 12/1990 | Jeffrey | 124/25 |
| 4,989,577 | A | * | 2/1991 | Bixby | 124/25.6 |
| 5,092,308 | A | * | 3/1992 | Sheffield | 124/25 |
| 5,099,819 | A | * | 3/1992 | Simonds et al. | 124/23.1 |
| 5,205,268 | A | * | 4/1993 | Savage | 124/24.1 |
| 5,243,957 | A | * | 9/1993 | Neilson | 124/88 |
| 5,503,135 | A | * | 4/1996 | Bunk | 124/16 |
| 5,651,354 | A | * | 7/1997 | La Haise, Sr. | 124/23.1 |
| 5,697,358 | A | * | 12/1997 | Campisi | 124/88 |
| 5,803,070 | A | * | 9/1998 | Martin et al. | 124/88 |
| 5,934,265 | A | * | 8/1999 | Darlington | 124/25.6 |
| 5,996,566 | A | * | 12/1999 | Malan | 124/23.1 |
| 6,092,516 | A | * | 7/2000 | Martin et al. | 124/88 |
| 6,371,098 | B1 | * | 4/2002 | Winther | 124/23.1 |
| 6,470,870 | B1 | * | 10/2002 | Schaar | 124/25.6 |
| 6,715,481 | B1 | * | 4/2004 | Anderson | 124/88 |
| 6,758,204 | B1 | * | 7/2004 | Goff et al. | 124/25.6 |
| 6,990,970 | B1 | * | 1/2006 | Darlington | 124/25.6 |
| 7,066,165 | B2 | * | 6/2006 | Perry | 124/23.1 |
| 7,832,386 | B2 | | 11/2010 | Bednar et al. | |
| D637,255 | S | | 5/2011 | Mcpherson | |
| 7,997,259 | B2 | | 8/2011 | Wilson | |
| 8,087,405 | B2 | * | 1/2012 | Mitchell | 124/67 |
| 8,191,541 | B2 | * | 6/2012 | Shaffer et al. | 124/25 |
| 8,439,025 | B2 | | 5/2013 | Shaffer et al. | |
| 8,522,762 | B2 | * | 9/2013 | Trpkovski | 124/25.6 |
| 8,622,050 | B2 | * | 1/2014 | Goff et al. | 124/25 |
| D701,933 | S | | 4/2014 | Mcpherson | |
| 8,794,225 | B2 | * | 8/2014 | Bednar et al. | 124/25 |
| 8,851,056 | B2 | * | 10/2014 | Trpkovski | 124/23.1 |
| 8,919,332 | B2 | * | 12/2014 | Trpkovski | 124/23.1 |
| 2008/0051232 | A1 | * | 2/2008 | Henry et al. | 473/578 |
| 2008/0092868 | A1 | * | 4/2008 | Silverson | 124/86 |
| 2010/0000504 | A1 | * | 1/2010 | Trpkovski | 124/25.6 |
| 2010/0051005 | A1 | | 3/2010 | Wilson | |
| 2011/0030666 | A1 | * | 2/2011 | Darlington | 124/25 |
| 2011/0303205 | A1 | * | 12/2011 | Goff et al. | 124/31 |
| 2013/0112182 | A1 | * | 5/2013 | Martin | 124/23.1 |
| 2014/0360480 | A1 | * | 12/2014 | Koch | 124/25.6 |

OTHER PUBLICATIONS

"Selected Pages from Liberty Archery web site regarding the Liberty Bow", www.libertyarchery.com Downloaded on Jan. 8, 2015, 22 pages.

"Selected Pages from Mathews Inc. web site regarding Bow product information", www.mathewsinc.com Downloaded on Jan. 6, 2015, 4 pages.

"Invitation to Pay Additional Fees," for PCT/US2014/068150, mailed Feb. 26, 2015 (6 pages).

"International Search Report and Written Opinion," for PCT/US2014/068150, mailed Jun. 24, 2015 (15 pages).

* cited by examiner

COMPACT COMPOUND BOW

CLAIM OF PRIORITY

This application claims the benefit of U.S. Provisional Application No. 61/910,930, filed Dec. 2, 2013, the content of which is herein incorporated by reference in its entirety.

FIELD OF THE TECHNOLOGY

The present application relates to compound bows. More specifically, the present application relates to ambidextrous compound bows and compact compound bows.

BACKGROUND

Archery bows have been in existence in many forms for thousands of years. Many ancient civilizations had a variety of bows that gave the bow unique features and more power. In recent years, compound bows also had many improvements to increase power, improve efficiency, balance, improve accuracy, and decrease the shock that the weapon produces during and after the shot. Many archers enjoy bow hunting, will carry their bows for extensive distances and would prefer to carry their bows on or within backpacks. Compact compound bows provide advantages for these archers.

Most modern compound bows are designed to fit either a left or right handed archer and must be unique for each. Accordingly, there is also a need for an ambidextrous bow.

SUMMARY

In various embodiments, a compound bow that includes a riser assembly comprising a first riser plate and a second riser plate, wherein a gap is defined between the first riser plate and the second riser plate, is provided. The compound bow can further include a first limb and a second limb, the first limb and second limb coupled to and extending in opposite directions from the riser assembly; a first pulley disposed at a distal end of the first limb; and a second pulley disposed at a distal end of the second limb. In some embodiments, the first limb and the second limb are each at least substantially disposed within the gap defined by the riser assembly.

In an embodiment, the first limb and second limb are each disposed within the gap defined by the riser assembly.

In an embodiment, the first limb and second limb each comprise a left limb part and a right limb part; wherein for each of the first limb and second limb, at least one of the left limb part and right limb part and at least a portion of the other limb part are disposed within the gap defined by the riser assembly.

In an embodiment, the first riser plate and the second riser plate are substantially parallel.

In an embodiment, the first riser plate and the second riser plate are substantially similar.

In an embodiment, in the gap is at least 1.5 inches wide.

In an embodiment, a distance between an axle of the first pulley and an axle of the second pulley is no greater than 24 inches in a resting position.

In an embodiment, the first limb and second limb are offset from a vertical center plane of the compound bow to the left or right, and wherein a drawstring is positioned on the vertical center plane of the compound bow.

In an embodiment, the first limb and second limb are offset from the vertical center plane of the compound bow to the right when the bow is in a right-handed configuration, and wherein the first limb and second limb are offset from the vertical center plane of the compound bow to the left when the bow is in a left-handed configuration.

In an embodiment, the bow can further include a crossbow stock comprising a string latch, wherein the crossbow stock is coupled to the riser assembly.

In an embodiment, the bow can further include a removeable handle configured to attach to and detach from the riser assembly. The crossbow stock can be configured to attach to and detach from the riser assembly, and the compound bow is configured to be used in crossbow configuration when the crossbow stock is attached to the riser plate assembly or in a non-crossbow configuration when the removeable handle is coupled to the riser plate assembly.

In various embodiments, a compound bow that includes a riser assembly; a first limb and a second limb each coupled to and extending in opposite directions from the riser assembly; a first pulley comprising a first axle is disposed at a distal end of the first limb; a second pulley comprising a second axle is disposed at a distal end of the second limb; a drawstring extending from the first pulley to the second pulley; and at least one cable extending from the first pulley to the second pulley, is provided. In some embodiments, the cable is positioned to the right or left of the drawstring. In some embodiments, a distance between the first axle and the second axle is no greater than 24 inches in a resting position.

In an embodiment, the cable is positioned to the right of the drawstring when the compound bow is in a right-handed configuration and the cable is positioned to the left of the drawstring when the compound bow is in a right-handed configuration.

In an embodiment, the bow can further include a cable guide coupled to the compound bow, wherein the cable guide retains at least a portion of the cable to the right or left of the drawstring.

In an embodiment, the cable guide is re-locatable between a first and second position.

In an embodiment, the bow can further include a re-locatable stabilizer mount coupled to the riser assembly wherein the compound bow is configured so that the re-locatable stabilizer mount can be positioned below a horizontal center plane of the bow.

In an embodiment, the bow can further include a D-loop extension coupled to the drawstring, wherein the D-loop extension has a length that is 1.5 inches or greater and is configured to increase a draw length for a user.

In an embodiment, the bow can further include a handle coupled to the riser assembly, wherein the riser assembly comprises a first riser plate and a second riser plate defining a gap between the first riser plate and the second riser plate, wherein the riser assembly defines a sight window between a top of a handle and a bottom of the first or second pulley or a proximal end or a first or second limb, whichever is lower when the compound bow is fully drawn, wherein a height of the sight window is at least 4 inches.

In various embodiments, a compound bow that includes a riser assembly comprising a first riser plate and a second riser plate; a first limb and a second limb each coupled to and extending in opposite directions from the riser assembly; a first pulley disposed at a distal end of the first limb; a second pulley disposed at a distal end of the second limb; and a re-locatable handle comprising a top end and a bottom end, the re-locatable handle configured to be re-locatable from a first position to a second position, is provided. In some embodiments, when the re-locatable handle is in the first position the top end of the handle is towards the first pulley and the bottom end is towards the second pulley, and when the re-locatable handle is in the second position the top end of the handle is towards the second pulley and the bottom end is towards the first pulley.

In an embodiment, the compound bow is in a right-handed configuration when the re-locatable handle is in the first position and the first limb is above a horizontal center plane, and wherein the compound bow is in a left-handed configuration when the re-locatable handle is in the second position and the second limb is above the horizontal center plane.

In an embodiment, the riser assembly defines a first position mounting structure and a second position mounting structure for a stabilizer mount; and the first position mounting structure defines a first plurality of apertures, and the second position mounting structure defines a second plurality of apertures.

In an embodiment, the re-locatable handle is rotated about 180 degrees from the first position to the second position.

In an embodiment, the bow can further include a cable guide configured to retain one or more cables out of an arrow pathway, wherein the arrow pathway is a pathway of an arrow shot from the compound bow.

In an embodiment, when the re-locatable handle is in the first position the cable guide retains one or more cables to the right of the arrow pathway and when the re-locatable handle is in the second position the cable guide retains one or more cables to the left of the arrow pathway.

In an embodiment, the cable guide is a re-locatable cable guide, wherein the re-locatable cable guide is configured to be re-locatable between two positions along a vertical axis.

In an embodiment, the two positions along a vertical axis are on the same riser plate.

In an embodiment, the bow is configurable into a right-handed arrangement and a left handed arrangement, depending on the position of the re-locatable handle and the re-locatable cable guide.

In an embodiment, the bow can further include a drawstring extending from the first pulley to the second pulley and the bow can be changed from a right-handed arrangement to a left-handed arrangement without adjusting a tension of the drawstring.

In an embodiment, the bow can further include at least one sight mount located on one side of a horizontal center plane and at least one sight mount located on the other side of the horizontal center plane.

In various embodiments, a compound bow that includes a riser assembly comprising a first riser plate and a second riser plate defining a gap between the first riser plate and the second riser plate; a first limb and a second limb, the first limb and the second limb coupled to and extending in opposite directions from the riser assembly, wherein the first limb and the second limb are disposed within the gap; a first pulley comprising a first axle, wherein the first pulley is disposed at a distal end of the first limb; a second pulley comprising a second axle, wherein the second pulley is disposed at a distal end of the second limb; a drawstring extending from the first pulley to the second pulley; at least one cable extending from the first pulley to the second pulley; a cable guide configured to retain at least a portion of the at least one cable to the right or left of the drawstring; and a re-locatable handle comprising a top end and a bottom end, the re-locatable handle configured to be re-locatable from a first position to a second position, is provided. In some embodiments, when the re-locatable handle is in the first position the top end of the handle is towards the first pulley and the bottom end is towards the second pulley, and when the re-locatable handle is in the second position the top end of the handle is towards the second pulley and the bottom end is towards the first pulley. In some embodiments, the distance between the first axle and the second axle is no greater than 24 inches in a resting position.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present application is defined by the appended claims and their legal equivalents.

BRIEF DESCRIPTION OF THE FIGURES

The technology may be more completely understood in connection with the following drawings, in which.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Described herein are various embodiments of a compact compound bow. A compact compound bow can have an axle to axle distance of 24 inches or less. The compact compound bow can be configured to fit within a backpack, such that an archer can easily transport the bow. In several embodiments, the compact bow can be ambidextrous, such that the bow can be easily converted from a configuration for a right handed archer to a configuration for a left handed archer.

Figure 1:
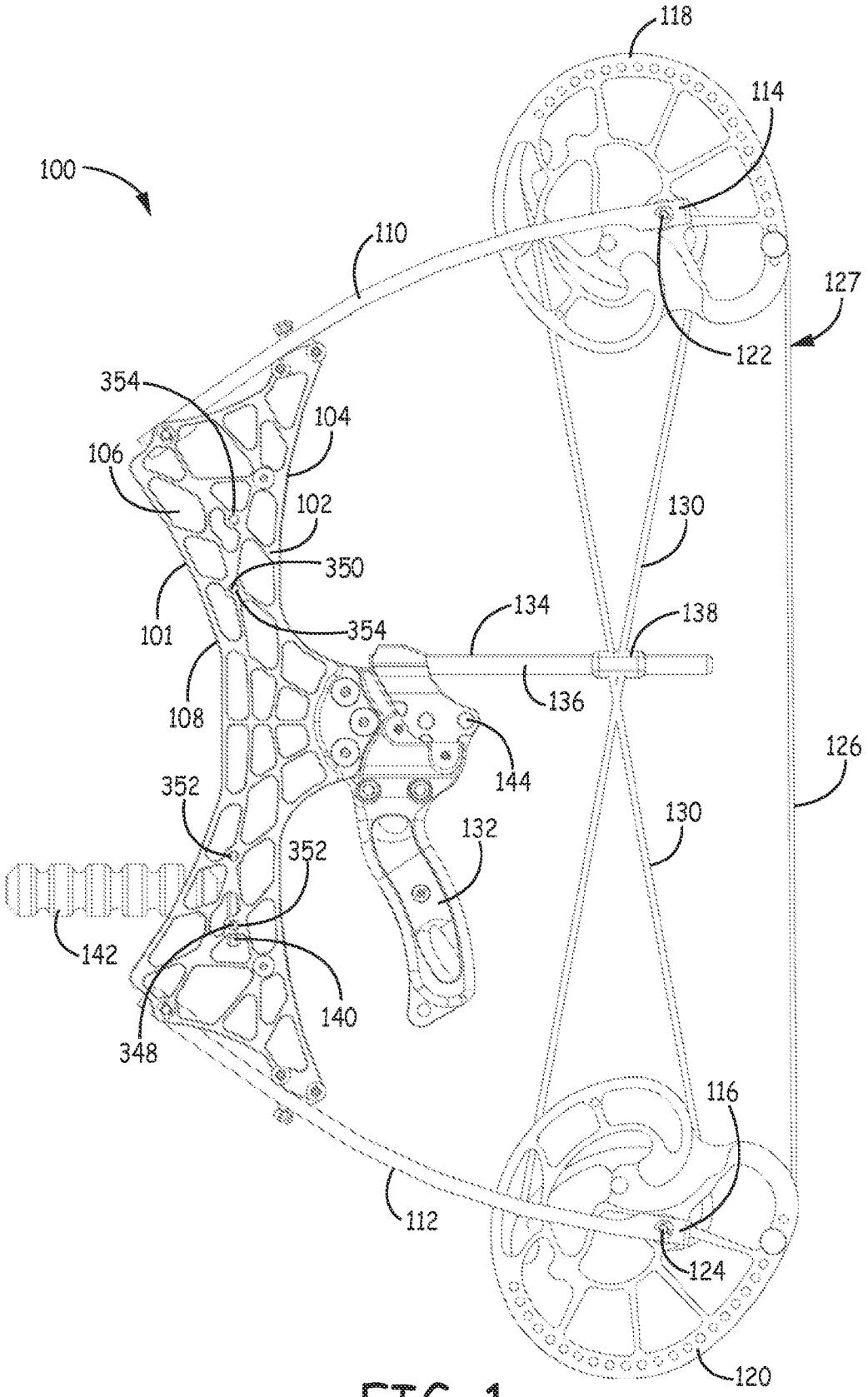
FIG. 1 is a view of a compact compound bow, according to an embodiment.

FIG. 1 shows a compact compound bow 100, according to an embodiment. The bow 100 can be compact, such that it can fit within a backpack. In an embodiment, the axle to axle distance of the bow 100 can be 24 inches or less. In an embodiment, the depth (from front of the riser plates to the drawstring) of the bow 100 can be 18 inches or less. The width (from an outside edge of the first riser plate to the outside edge of the second riser plate) of the bow 100 can be 6 inches or less.

The bow 100 can be ambidextrous, such that it can be used in a right-hand configuration and a left-hand configuration, such as by moving the location of the handle. The right-hand configuration can refer to a configuration for a right-handed archer, such that the archer holds the bow with his or her left hand and draws the arrow with his or her right hand. The left-hand configuration can refer to a configuration for a left-handed archer, such that the archer holds the bow with his or her right hand and draws the arrow with his or her left hand. In an embodiment, the bow 100 can be converted from a right-hand configuration to a left hand configuration without removing significant tension from the drawstring or cable(s), such as without relieving tension using a bow press, without unstringing the drawstring or cable(s), or both.

The bow 100 can include a riser assembly 101. The riser assembly can include a first riser plate 102 and a second riser plate 104 (shown in FIG. 3). The riser assembly 101 can provide a base for the bow 100, such that other components are coupled to it. The riser plates 102, 104 can be rigid, such that the plates 102, 104 minimally deform during standard operation of the bow 100. The riser plates 102, 104 can include a metal, polymer, or carbon fiber. Each riser plate 102, 104 can have a thickness that ranges from 0.05 inches to 1 inch, such as 0.25 inches. Each riser plate 102, 104 can have a thickness that ranges from 0.05 to 0.25 inches. The riser plates 102, 104 can be substantially similar, such as the two riser plates 102, 104 are identical. The riser plates 102, 104 can be formed or created from the same mold. The riser plates 102, 104 can be punched from a sheet of metal using the same die. The riser plates 102, 104 can be cut from a sheet of metal, such as using the same cutting template or coordinates. The riser plates 102, 104 can define a plurality of apertures 106, such as to reduce the weight of the bow 100. The riser plates 102,104 can have an arced front portion 108, such as a portion towards the front of the bow 100 that arcs inwards towards the handle or the drawstring. The riser plates 102, 104 can have an arced back portion 109, such as a back portion of the riser plates 102, 104 that arcs towards the front of the bow 100, such as to provide the archer's hand clearance while grasping the handle. The arced portions 108, 109 can be curved or swept in the described directions.

In an embodiment, the bow 100 can include at least one riser plate. In an embodiment, the bow 100 can include only one riser plate. In an embodiment, the bow 100 can include two riser plates that are integral with each other.

The bow 100 can include two limbs, such as a first limb 110 and a second limb 112. In some embodiments, the first limb 110 can be an upper limb 110 and the second limb 112 can be a lower limb 112 in a right-handed configuration. The first limb 110 and the second limb 112 can be coupled to the riser assembly 101. The first limb 110 and the second limb 112 can extend from the riser assembly 101, such as in opposite directions from the riser assembly 101.

Figure 2:
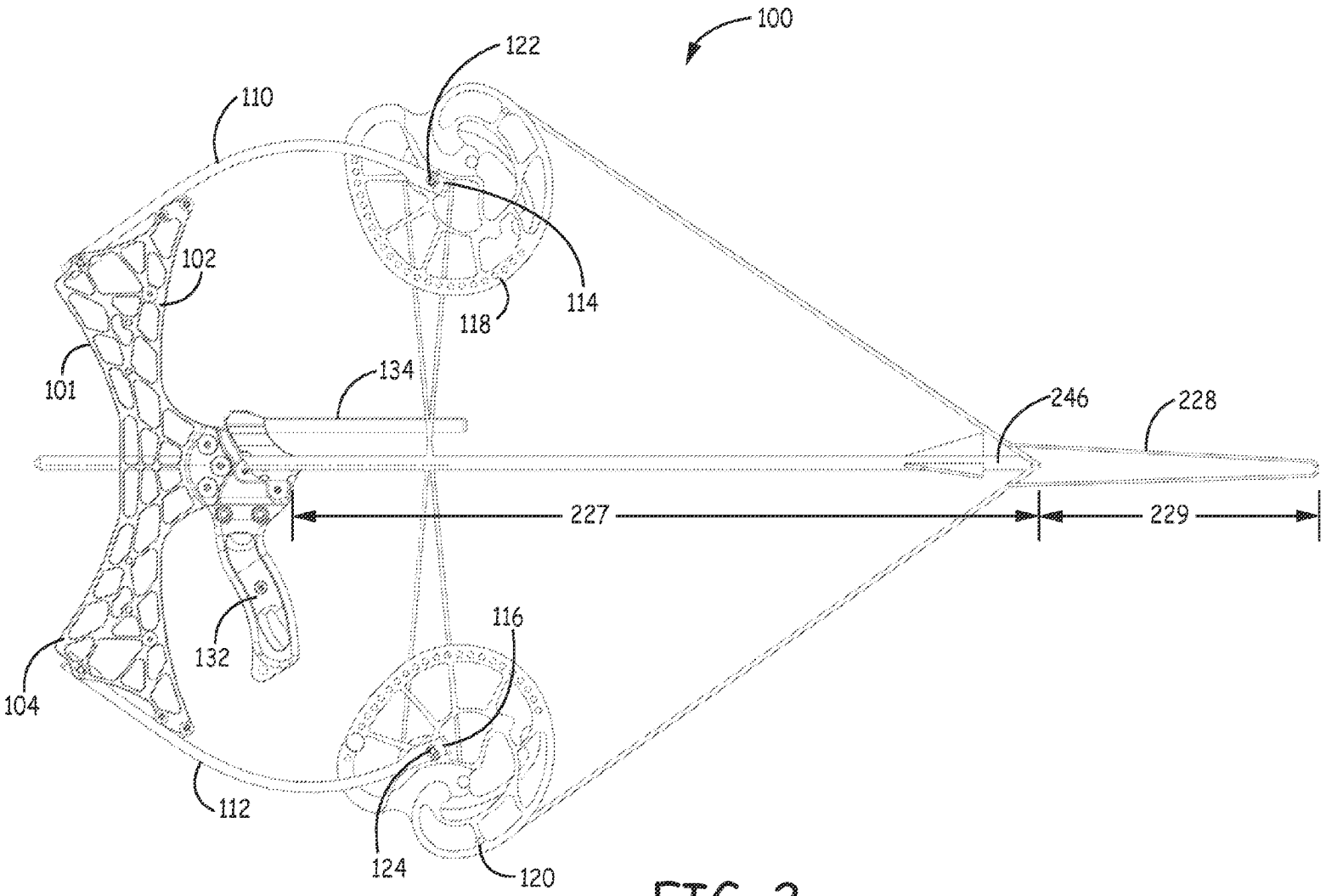
FIG. 2 is a view of a compact compound bow, according to an embodiment.

The limbs 110, 112 can be coupled to the first riser plate 102, the second riser plate 104, or both. In an embodiment, the first limb 110 can refer to the top limb when the bow is in a right-hand configuration. The limbs 110, 112 can be coupled to the riser plates 102, 104 to form an interior angle of between 180° and 90°. The limbs 110, 112 can be flexible, such that the limb 110, 112 flex or bend as the drawstring is drawn back by an archer, as shown in FIG. 2, such as to store energy to propel the arrow when the archer releases the drawstring. The limbs 110, 112 can be split limbs, such that the first limb 110 and the second limb 112 each include two parallel limbs. In an alternative embodiment, the limbs 110, 112 can each include a single limb with forked distal end. The forked distal end can be a separation of the limb, such as to form a "Y" shape. The forked distal end can be a split in the limb such as to form a separation. In various embodiments, one or more pulleys can be disposed within the forked distal end of each the first limb 110 and the second limb 112, such as within the separation defined by the forked distal end. In various embodiments, each limb 110, 112 can include two parts, such as a right limb part and a left limb part.

The limbs 110, 112 can include a proximal end that is coupled to the first riser plate 104 and/or the second riser plate 106. The first limb 110 can include a distal end 114 and the second limb 112 can include a distal end 116. The proximal ends of the limbs 110, 112 can be disposed between the first riser plate 102 and the second riser plate 104, such as to decrease the width of the bow 100 relative to the width of a bow with the proximal ends of the limbs disposed or coupled to the riser plates on an outer surface. Further, coupling the proximal ends in the space between the riser plates 102, 104 can decrease the height of the bow 100 relative to a bow with the proximal ends couple to the top and bottom portions of the riser plates. In various embodiments, for each of the first limb 110 and the second limb 112 at least one of the left limb part and the right limb part and at least a portion of the other limb part are disposed within the gap defined by the riser assembly 101. In one embodiment, for each of the first and second limbs, the entire left limb part is within the gap and only part of the right limb part is within the gap. In one embodiment, for each of the first and second limbs, the entire right limb part is within the gap and only part of the left limb part is within the gap.

Figure 5:
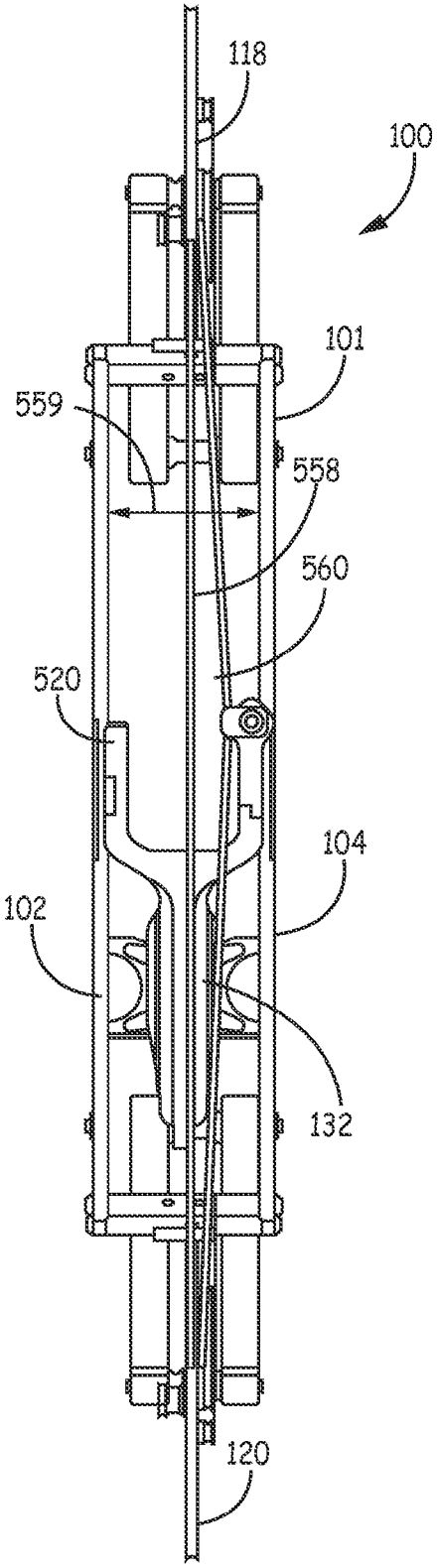
FIG. 5 is a back view of a compact compound bow, according to an embodiment.

In an embodiment, the proximal ends of the limbs 110, 112 can be coupled to the riser plates 102, 104 within the gap 558 (shown in FIG. 5). In some embodiments, at least one of the proximal ends of the limbs 110, 112 are coupled to the riser plates 102, 104 within the gap 558.

Figure 3:
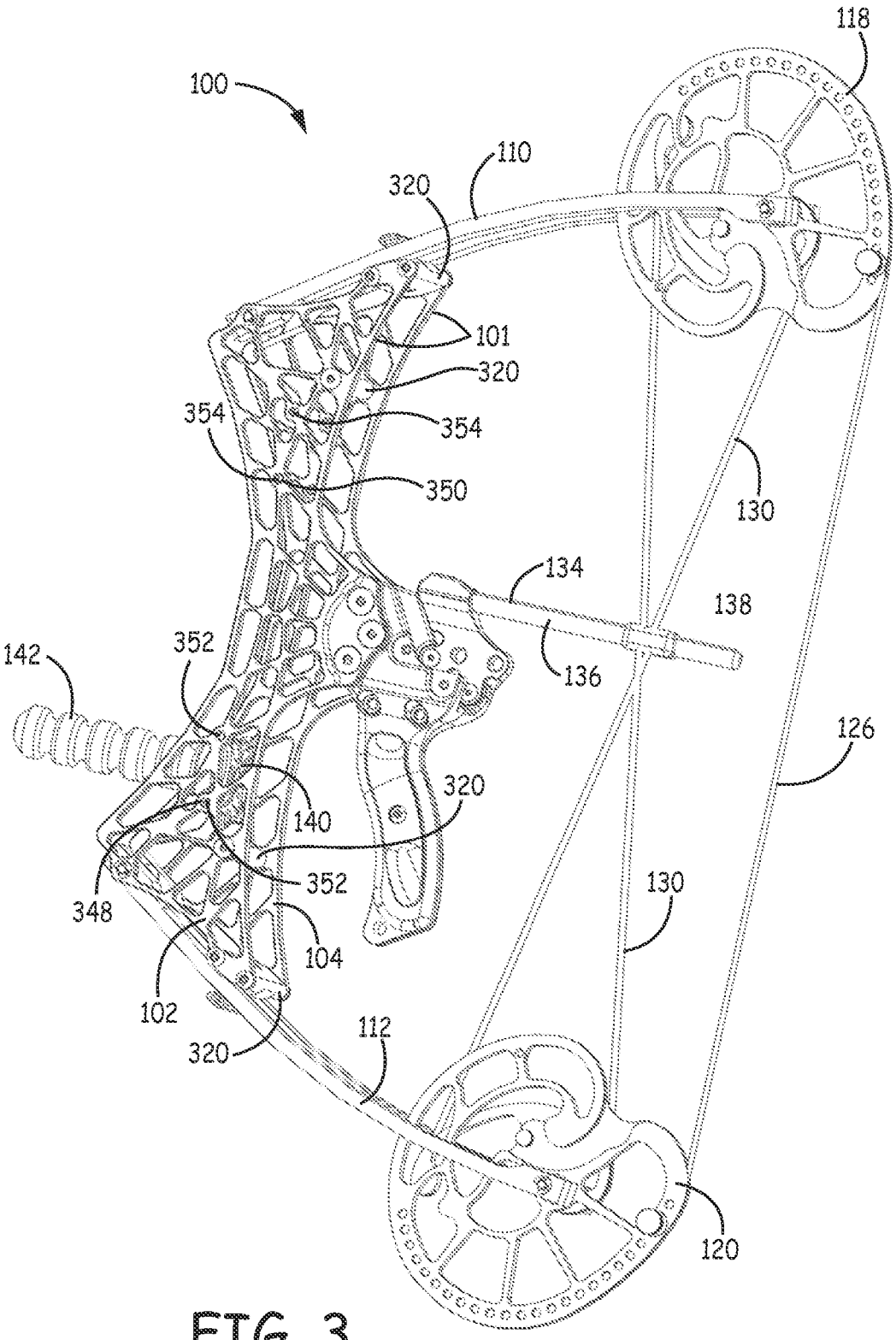
FIG. 3 is a perspective view of a compact compound bow, according to an embodiment.

In an embodiment, one or more riser connectors 320 connect the first riser plate 102 to the second riser plate 104, as seen in FIG. 3. In various embodiments, the riser connectors are elongated members, such as a bar or dowel, coupled to the first riser plate 102 and the second riser plate 104, such as to couple the plates 102, 104 with each other. The riser connectors 320 can be disposed in the gap 558. The riser connectors 320 can be perpendicular to the riser plates 102, 104. In various embodiments, the proximal ends of the limbs 110, 112 can be coupled to riser connectors 320.

The bow 100 can include one or more pulleys or cams, such as a first pulley 118 and a second pulley 120. The first pulley 118 can be coupled to the distal end 114 of the first limb 110 and the second pulley 120 can be coupled to the distal end 116 of the second limb 112. The first pulley 118 can rotate around a first axle 122. The second pulley 120 can rotate around a second axle 124. In various embodiments, the first pulley 118 can include one or more pulleys and/or one or more cams. Similarly, the second pulley 120 can include one or more pulleys and/or one or more cams. In an embodiment, the first and second pulleys 118, 120 can be arranged as described in detail in U.S. Pat. No. 7,997,259, issued Aug. 16, 2011, incorporated herein by reference in its entirety.

In various embodiments, the distance from the first axle 122 to the second axle 124 can be at least 10 inches. In various embodiments, the distance from the first axle 122 to the second axle 124 can at least 11 inches. In various embodiments, the distance from the first axle 122 to the second axle 124 can at least 12 inches. In various embodiments, the distance from the first axle 122 to the second axle 124 can at least 13 inches. In various embodiments, the distance from the first axle 122 to the second axle 124 can at least 14 inches. In various embodiments, the distance from the first axle 122 to the second axle 124 can at least 15 inches.

In various embodiments, the distance from the first axle 122 to the second axle 124 can be no more than 24 inches. In various embodiments, the distance from the first axle 122 to the second axle 124 can be no more than 23 inches. In various embodiments, the distance from the first axle 122 to the second axle 124 can be no more than 22 inches. In various embodiments, the distance from the first axle 122 to the second axle 124 can be no more than 21 inches.

In an embodiment, the distance from the first axle 122 to the second axle 124 can be at least 10 inches and not more than 24 inches. In an embodiment, the distance from the first axle 122 to the second axle 124 can be at least 12 inches and not more than 24 inches. In an embodiment, the distance from the first axle 122 to the second axle 124 can be at least 10 inches and not more than 22 inches. In an embodiment, the distance from the first axle 122 to the second axle 124 can be at least 12 inches and not more than 22 inches.

In an embodiment, the distance from the first axle 122 to the second axle is about 25 inches. In an embodiment, the distance from the first axle 122 to the second axle is about 24 inches. In an embodiment, the distance from the first axle 122 to the second axle is about 23 inches. In an embodiment, the distance from the first axle 122 to the second axle is about 22 inches. In an embodiment, the distance from the first axle 122 to the second axle is about 21 inches. In an embodiment, the distance from the first axle 122 to the second axle is about 20 inches.

The bow 100 can include a drawstring 126 extending from the first pulley 118 to the second pulley 120. The drawstring 126 can have a high tensile strength and/or a minimal amount of elasticity. The drawstring 126 can be configured to transfer the energy from the bow 100 to an arrow that is being shot from the bow 100. In some embodiments, the drawstring 126 can include polyethylene, such as a high-modulus polyethylene, or plastic coated steel. In various embodiments, the drawstring 126 is coupled to a D-loop 228 (shown in FIG. 2), such as to increase the draw length for the archer. In some embodiments, the drawstring 126 can include a peep hole at approximately 127. The peep hole can be an aperture defined within the drawstring 126, such as to aid in aiming the bow 100. The archer can align the peep hole with a sight. The compactness of bow 100 can result in a position for the peep hole farther away from the archer's eye and closer to the sight, thereby increase accuracy in some situations compared to when the peep hole is closer to the archer's eye.

The bow 100 can further include one or more cables 130. The one or more cables 130 can extend from the first pulley 118 to the second pulley 120. In some embodiments, the bow 100 can include two cables 130. The two cables 130 can cross each other, such as to form an "X" shape (as shown in FIG. 1). The cables 130 can provide additional energy to an arrow being shot from the bow 100. The cable(s) 130 can aid the first pulley 118 and second pulley 120 in reducing the amount of force the archer needs to exert in order to further draw the drawstring 126 back or to hold the drawstring 126 in a drawn position.

The bow 100 can include a handle 132. The handle 132 can be configured to allow an archer to hold the bow 100 with his or her hand. The handle 132 can be re-locatable, such that the handle can be coupled to the first riser plate 102 and/or second riser plate 104 in a first position, or the handle can be coupled to the first riser plate 102 and/or the second riser plate 104 in a second position, such as if the first position is configured for a right-handed archer and the second position is configured for a left-handed archer.

In various embodiments, the bow can include a cable guide 134. The cable guide 134 can be configured to guide the cable(s) 130 out of the path of an arrow being shot by the bow 100 or being prepared to be shot by the bow 100. In an embodiment, the cable guide 134 can include a cable slide 136 and a slide block 138. The slide block 138 can be configured to slide along the cable slide 136, such as when the drawstring 126 is drawn back. In an embodiment, the cable guide 134 can include a pulley or roller to guide the cable(s) 130 away from an arrow. The cable guide 134 can be coupled to the handle 132. In an embodiment, the cable guide 134 can be coupled to the first or second riser plate 102, 104.

The bow 100 can include a stabilizer mount 140. The stabilizer mount 140 can be coupled to the first riser plate 102 and/or the second riser plate 104. The stabilizer mount 140 can be coupled to a stabilizer 142. The stabilizer mount 140 can be configured to attach or couple various accessories to the bow 100, such as a fishing reel, stabilizer weight, or a chronograph.

In reference now to FIG. 2, the compact compound bow 100 is shown with an arrow 246 and the drawstring 126 in a drawn position, such that the arrow 246 is prepared to be shot. When the drawstring 126 is drawn away from the riser plates 102, 104, the first and second pulleys 118, 120 can rotate, such as along the first and second axles 122, 124. The pulleys 118, 120 can be rotated inward, such that the closest parts of the pulleys 118, 120 are closer to each other than when the drawstring 126 is relaxed or not drawn back. The distance between the closest portions of the pulleys 118, 120 can be large enough to allow the arrow 246 to pass between the pulleys 118,120. The distance between the pulleys 118, 120 can also be large enough to allow the archer to look between the pulleys 118 in a direction parallel with the arrow 246, such as when the archer is aiming the bow for his or her shot.

As discussed above, the bow 100 can include a D-loop 228 coupled to the drawstring 126. The D-loop 228 can include a piece of drawstring or another material. In an embodiment, a D-loop 228 includes a string like element that is includes two ends. Both of the two ends can be tied to the drawstring with a space between the two ends. The space can be configured for the notch of an arrow to be disposed within. In an embodiment, the D-loop 228 can be used to increase the draw length of the bow 100, such as to conform to an archer who has a larger draw length than the bow without the D-loop 228 is configured to have. The bow 100 draw length can be adapted to the archer's draw length by adjusting the length of the D-loop 228.

The D-loop 228 can have a length from the drawstring 126 to the end of the D-loop 228 represented by dimension 229 in FIG. 2. The D-loop length is measured when the D-loop and drawstring are under tension and pulled back into the drawn position. The D-loop 228 can have a length from the drawstring 126 to the end of the D-loop 228 of at least 0.5 inches, at least 1 inch, at least 1.5 inches, at least 2 inches, at least 3 inches, at least 4 inches, or at least 5 inches. D-loop 228 can have a length from the drawstring 126 to the end of the D-loop 228 of no more than 13 inches, no more than 12 inches, no more than 11 inches, no more than 10 inches, or no more than 8 inches.

The draw length of the bow 100 without a D-loop can be represented as dimension 227 in FIG. 2. The draw length of the bow 100 can be from the handle 132 to the end of the drawstring 126 when the drawstring 126 is fully drawn by the archer. When a bow is "fully drawn", the drawstring is drawn away from the rest of the bow, thereby flexing and storing energy in the limbs sufficient to propel an arrow forward. In various embodiments, the bow 100, without a D-loop, can have a draw length of at least 14 inches. In various embodiments, the bow 100, without a D-loop, can have a draw length of at least 15 inches. In various embodiments, the bow 100, without a D-loop, can have a draw length of at least 16 inches.

In various embodiments, the bow 100, without a D-loop, can have a draw length of no more than 27 inches. In various embodiments, the bow 100, without a D-loop, can have a draw length of no more than 26 inches. In various embodiments, the bow 100, without a D-loop, can have a draw length of no more than 25 inches. In an embodiment, the bow 100, without a D-loop, can have a draw length of about 23 inches.

In various embodiments, the bow 100, without a D-loop, can have a draw length of at least 14 inches and not more than 26 inches. In various embodiments, the bow 100, without a D-loop, can have a draw length of at least 14 inches and not more than 25 inches. In various embodiments, the bow 100, without a D-loop, can have a draw length of at least 14 inches and not more than 24 inches. In various embodiments, the bow 100, without a D-loop, can have a draw length of at least 14 inches and not more than 23 inches. In various embodiments, the bow 100, without a D-loop, can have a draw length of at least 14 inches and not more than 22 inches. In various embodiments, the bow 100, without a D-loop, can have a draw length of at least 14 inches and not more than 21 inches.

In an embodiment, the bow 100, without a D-loop can have a draw length of about 20 inches. In an embodiment, the bow 100, without a D-loop can have a draw length of about 21 inches. In an embodiment, the bow 100, without a D-loop can have a draw length of about 22 inches. In an embodiment, the bow 100, without a D-loop can have a draw length of about 23 inches. In an embodiment, the bow 100, without a D-loop can have a draw length of about 24 inches. In an embodiment, the bow 100, without a D-loop can have a draw length of about 25 inches.

In an embodiment, a bow 100 can have a draw length without a D-loop of 15 inches and a D-loop of 5 inches, such as to result in a 20 inch draw length for the archer. Alternative ratios of D-loop length to the bow's draw length without a D-loop are possible such as a ratio of 1:3, 1:5, 1:7, or 1:9. In an embodiment, a bow has a ratio of between 1:3 and 1:5. In an embodiment, a bow has a ratio of between 1:3 and 1:7. In an embodiment, a bow has a ratio of between 1:3 and 1:9. In an embodiment, a bow has a ratio of between 1:3 and 1:11. In an embodiment, a bow has a ratio of between 1:3 and 1:15. In an embodiment, a bow has a ratio of between 1:3 and 1:20.

FIG. 3 shows a perspective view of the bow 100. FIG. 3 shows the first riser plate 102 and the second riser plate 104. In an embodiment, the first riser plate 102 and the second riser plate 104 are parallel. In an embodiment, the first riser plate 102 and the second riser plate 104 are substantially parallel. As used herein, "substantially parallel" means that the two riser plates are within 5 degrees or less of a parallel orientation. The first riser plate 102 and second riser plate 104 can be substantially the same, such that the two riser plates 102, 104 are interchangeable with each other or the two riser plates 102, 104 are identical. In an embodiment, the first riser plate 102 and the second riser plate 104 are mirrored. In other words, the first riser plate 102 is a mirror image of the second riser plate 104. In an embodiment, the first riser plate 102 and second riser plate 104 are symmetric with each other. In an embodiment the first riser plate 102 and the second riser plate 104 are symmetric, such that the top portions of the riser plates 102, 104 are similar to the bottom halves of the riser plates 102, 104. In an embodiment, the riser plates 102, 104 are stamped, such as from a sheet of metal.

The first riser plate 102, the second riser plate 104 or both can define a first position mounting structure 348 and a second position mounting structure 350. The mounting structures 348, 350 can be configured to mount the stabilizer mount 140, a sight assembly or other structures in different positions. The stabilizer mount 140 is shown in FIGS. 1 and 3 attached to the first position mounting structure 348 and the bow 100 is configured for a right-handed archer. The stabilizer mount 140 can be attached to the second position mounting structure 350 when the bow 100 is configured for a left-handed archer. In both of these configurations, the stabilizer mount 140 will be positioned below the arrow rest and below the attachment point of the handle 132 with the riser assembly 101.

The first position mounting structure 348 can define a first plurality of apertures 352. The second position mounting structure 350 can define a second plurality of apertures 354. In one embodiment, each mounting structure 348, 350 comprises two apertures on a first riser plate 102 and two apertures on a second riser plate 104, for a total of four apertures for each mounting structure 348, 350. In one embodiment, each mounting structure 348, 350 comprises one aperture on a first riser plate 102 and one aperture on a second riser plate 104, for a total of two apertures for each mounting structure 348, 350. In one embodiment, each mounting structure 348, 350 comprises two apertures on a first riser plate 102 and two apertures on a second riser plate 104, for a total of four apertures for each mounting structure 348, 350. In various embodiments, other numbers of apertures are present, apertures are present in different locations on the riser assembly 101, or both.

The first plurality of apertures 352 and second plurality of apertures 354 can be configured for a plurality of fasteners, such as screws or bolts, to pass through a portion of the first riser plate 102 and/or second riser plate 104, such as to couple the stabilizer mount 140 to the bow 100.

Figure 4:
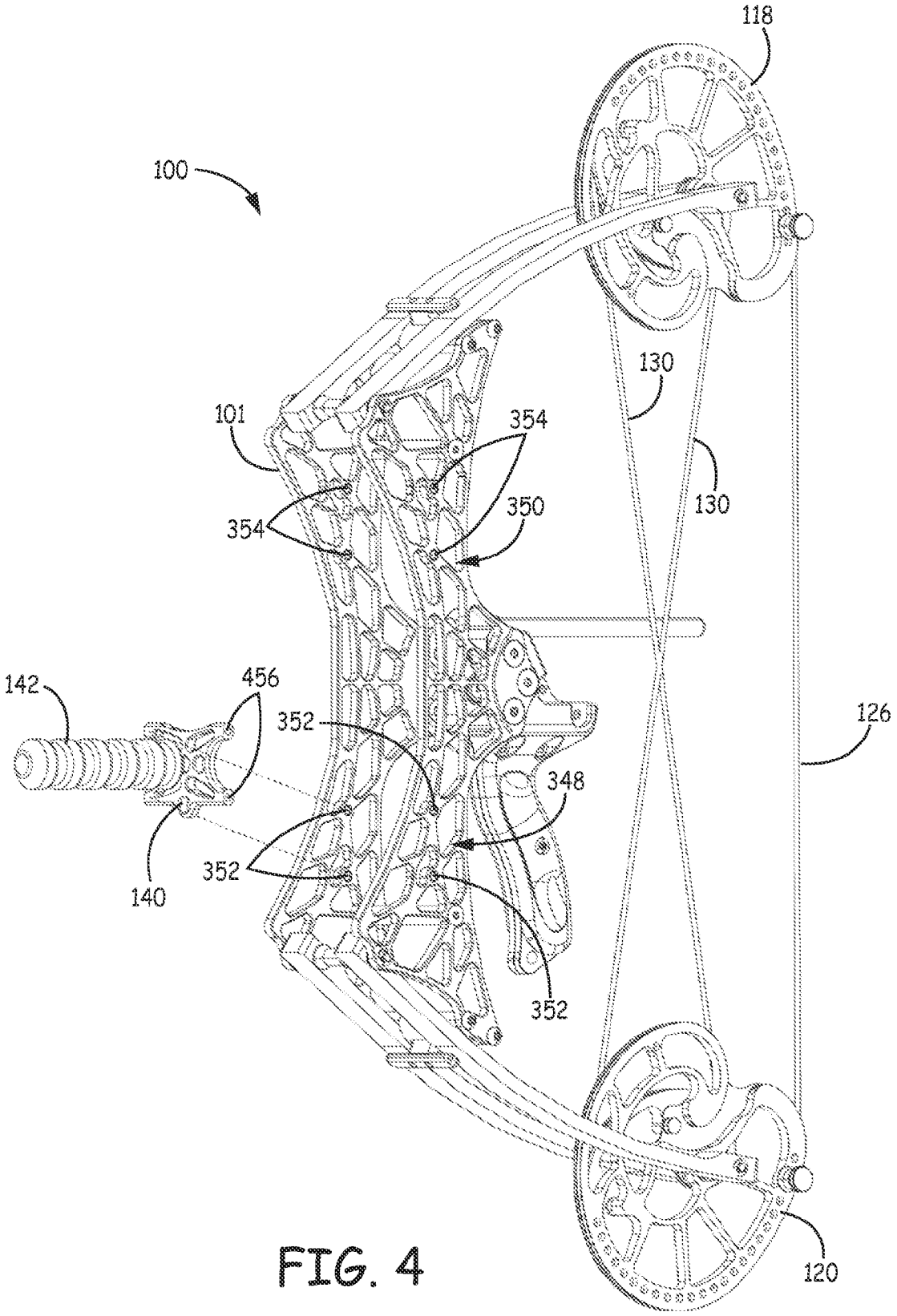
FIG. 4 is a perspective view of a compact compound bow, according to an embodiment.

FIG. 4 shows a partial exploded view of the bow 100, according to an embodiment. As discussed with reference to FIG. 3, the stabilizer mount 140 can be coupled to the bow 100 in different positions, such as depending if the bow 100 is configured for a right-handed archer or a left-handed archer. The stabilizer mount 140 can define a plurality of apertures 456, such as to accommodate a fastener or a plurality of fasteners, such as a fastener that passes through a portion of the first or second riser plate 102, 104 and into the stabilizer mount 140 to couple the stabilizer mount 140 to the bow 100.

Figure 15:
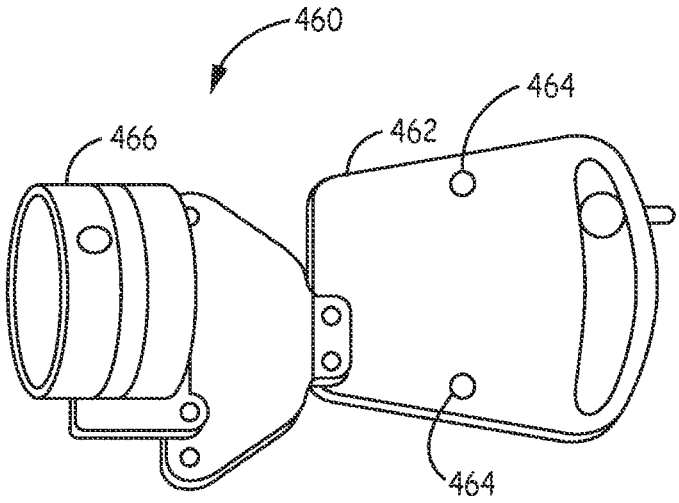
FIG. 15 is a perspective view of a sight assembly according to an embodiment.

The mounting structures 348, 350 can also be configured to mount a sight assembly in different positions. FIG. 15 shows one example of a sight assembly 460, including a sight 466 and a sight mount 462 defining two apertures 464. The apertures 464 are configured to facilitate attachment of the sight assembly 460 to apertures 354 on the second riser plate 104 when the bow is in the right handed configuration shown in FIGS. 3 and 4. The sight assembly 460 can attach to the first position mounting structure 348 when the bow 100 is configured for a left-handed archer, specifically to the apertures 352 of the first riser plate 102 shown in FIG. 4.

In some embodiments, the stabilizer mount 140 is located below the path of an arrow being shot from the bow 100. In some embodiments, the sight assembly 360 is located above the path of an arrow being shot from the bow 100.

In an alternative embodiment, a sight mount 144 can be coupled to, or alternatively defined by the handle 132, as shown in FIG. 1. In some embodiments, the handle can define two or more sight mounts 144, such as one sight mount on the right of the handle and one sight mount on the left. A different sight mount can be used when the bow 100 is configured for a right-handed archer as opposed to a left-handed archer.

Figure 6:
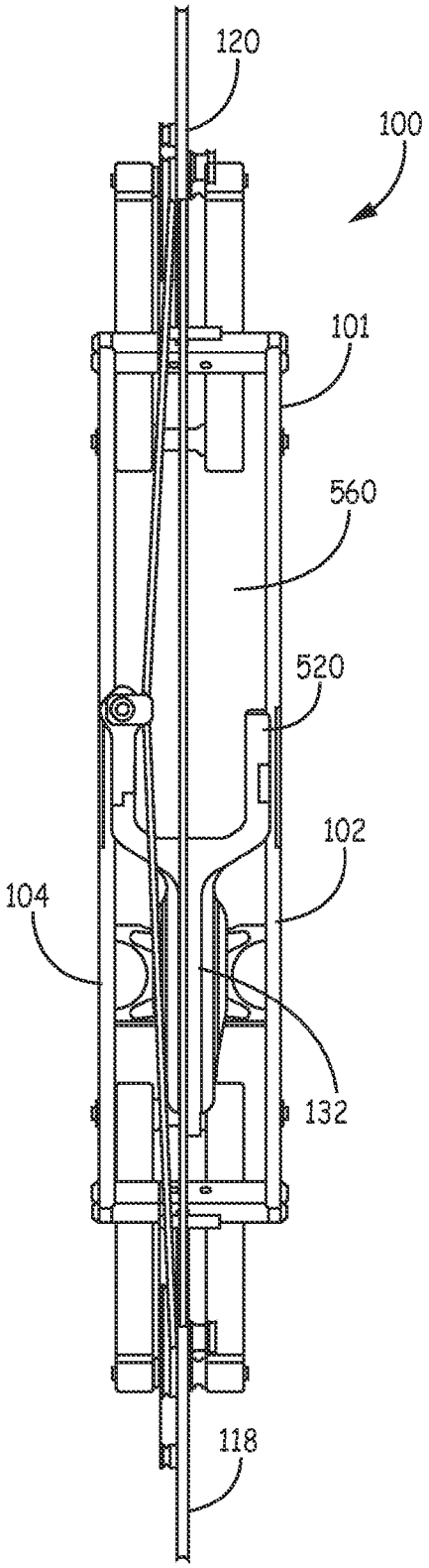
FIG. 6 is a back view of a compact compound bow, according to an embodiment.

FIG. 5 shows a back view of the bow 100 in a right hand configuration. FIG. 6 shows the same bow 100 as shown in FIG. 5 in a left hand configuration. In switching from a right hand configuration to a left hand configuration, or vice versa, the handle 132 can be rotated 180°. As shown in FIG. 5, the top of the handle 520 is towards the first pulley 118; however, in FIG. 6, the top of the handle 520 is towards the second pulley 120. In a right handed configuration, the cables 130 are guided to the right of the drawstring 126. In a left handed configuration, the cables 130 are guided to the left of the drawstring 126. FIGS. 5 and 6 further show the stabilizer mount 140 coupled to the bow 100 in different locations. In FIG. 5, the right handed configuration, the stabilizer mount 140 is coupled to the bow 100 closer to the second pulley 120. In FIG. 6, the left handed configuration, the stabilizer mount 140 is coupled to the bow 100 closer to the first pulley 118.

The first riser plate 102 and the second riser plate 104 can be separated by a gap 558. The gap 558 can include a center. In an embodiment, the gap 558 can have a width 559. The width 559 of the gap 558 can be at least 1.5 inches, at least 2.0 inches, or at least 2.5 inches. In an embodiment, the width 559 of the gap 558 can be no more than 6 inches, no more than 5 inches, no more than 4 inches, or no more than 3 inches.

In an embodiment, gap 558 can have a width 559 of at least 1.5 inches and not more than 5 inches. In an embodiment, the gap 558 can have a width 559 of at least 1.5 inches and not more than 4 inches. In an embodiment, gap 558 can have a width 559 of at least 1.5 inches and not more than 3 inches.

In an embodiment, the gap 558 can have a width of about 1.5 inches. In an embodiment, the gap 558 can have a width of about 2 inches. In an embodiment, the gap 558 can have a width of about 2.5 inches. In an embodiment, the gap 558 can have a width of about 3 inches. In an embodiment, the gap 558 can have a width of about 3.5 inches. In an embodiment, the gap 558 can have a width of about 4 inches. In an embodiment, the gap 558 can have a width of about 4.5 inches.

In various embodiments, the drawstring can be disposed along the center of the gap when viewed from the back, such as shown in FIG. 5 and FIG. 6. In various embodiments, a cam or pulley, such as a cam or pulley included in the first pulley 118 or the second pulley 120 can be offset from the center of the gap 558. In various embodiments, the limbs 110, 112 can be offset from the center of the gap 558. As discussed above, the limbs 110, 112 can be split limbs or can include a fork/separation at the distal end. In various embodiments, the drawstring 126 can be offset from the center of the split limbs or the center of the fork/separation. In some embodiments, the drawstring 126 is offset from the center of limbs 110, 112, such as when the limbs 110, 112 are split limbs or include a fork, because of additional pulleys or cams located on one side of the pulley attached to the drawstring. The additional pulleys or cams can be located on one side of the pulley for the drawstring 126, such as to bias the cables 130 in a direction away from the archer's arm that is holding the handle 132. As discussed above, the cables 130 can be further guided away from the arrow's path in a direction away from the archer's arm, such as to avoid the fletching of an arrow coming in contact with the cables when the arrow is shot. In various embodiments, the cables can be guided away from the path of the arrow, such that the arrow does not follow a path between two of the cables 130.

The limbs 110, 112 can be offset from the center of the gap 558, such as to position the drawstring in the center of the gap 558 when viewed from the back, such as shown in FIGS. 5 and 6. The drawstring 126 can be centered within the gap 558, such that when the bow 100 is configured for a right handed archer or the bow 100 is configured for a left handed archer the drawstring 126 is centered.

The gap 558 can include a sight window 560, such as the area in which an archer can look between the two riser plates 102, 104, above the arrow, and below the top pulley 118 or 120 or below the proximal ends of the top limb 110, 112, whichever is lower. The sight window 560 can be configured for the archer to have a view of the target he or she is aiming at. The sight window 560 can provide the archer with an unobstructed view of his or her target. In an embodiment, a sight can be mounted within the sight window 560, such as to aid the archer in aiming at the intended target.

In various embodiments, the sight window 560 can have a height of at least 4 inches between the handle, such as where the arrow can rest on the handle 132, and the bottom of the pulley 118 or 120, when the bow 100 is fully drawn. In various embodiments, the sight window 560 can have a width, such as the distance between the first riser plate 102 and the second riser plate 104, of at least 1.5 inches.

In various embodiments, the sight window 560 can have a width of at least 1.5 inches. In various embodiments, the sight window 560 can have a width of at least 2 inches. In various embodiments, the sight window 560 can have a width of at least 2.5 inches. In various embodiments, the sight window 560 can have a width of at least 3 inches. In various embodiments, the sight window 560 can have a width of at least 3.5 inches. In various embodiments, the sight window 560 can have a width of at least 4 inches. In various embodiments, the sight window 560 can have a width of at least 4.5 inches. In various embodiments, the sight window 560 can have a width of at least 5 inches. In various embodiments, the sight window 560 can have a width of at least 5.5 inches. In various embodiments, the sight window 560 can have a width of at least 6 inches.

In some embodiments, the sight window 560 can have a width of at least 1.5 inches and not more than 6 inches. In some embodiments, the sight window 560 can have a width of at least 1.5 inches and not more than 5 inches. In some embodiments, the sight window 560 can have a width of at least 1.5 inches and not more than 4 inches. In some embodiments, the sight window 560 can have a width of at least 1.5 inches and not more than 3 inches.

In some embodiments, the sight assembly 460 shown in FIG. 15 is configured so that the sight 466 will be positioned within the sight window 560 when the sight assembly 460 is attached to the riser assembly 101.

Figure 7:
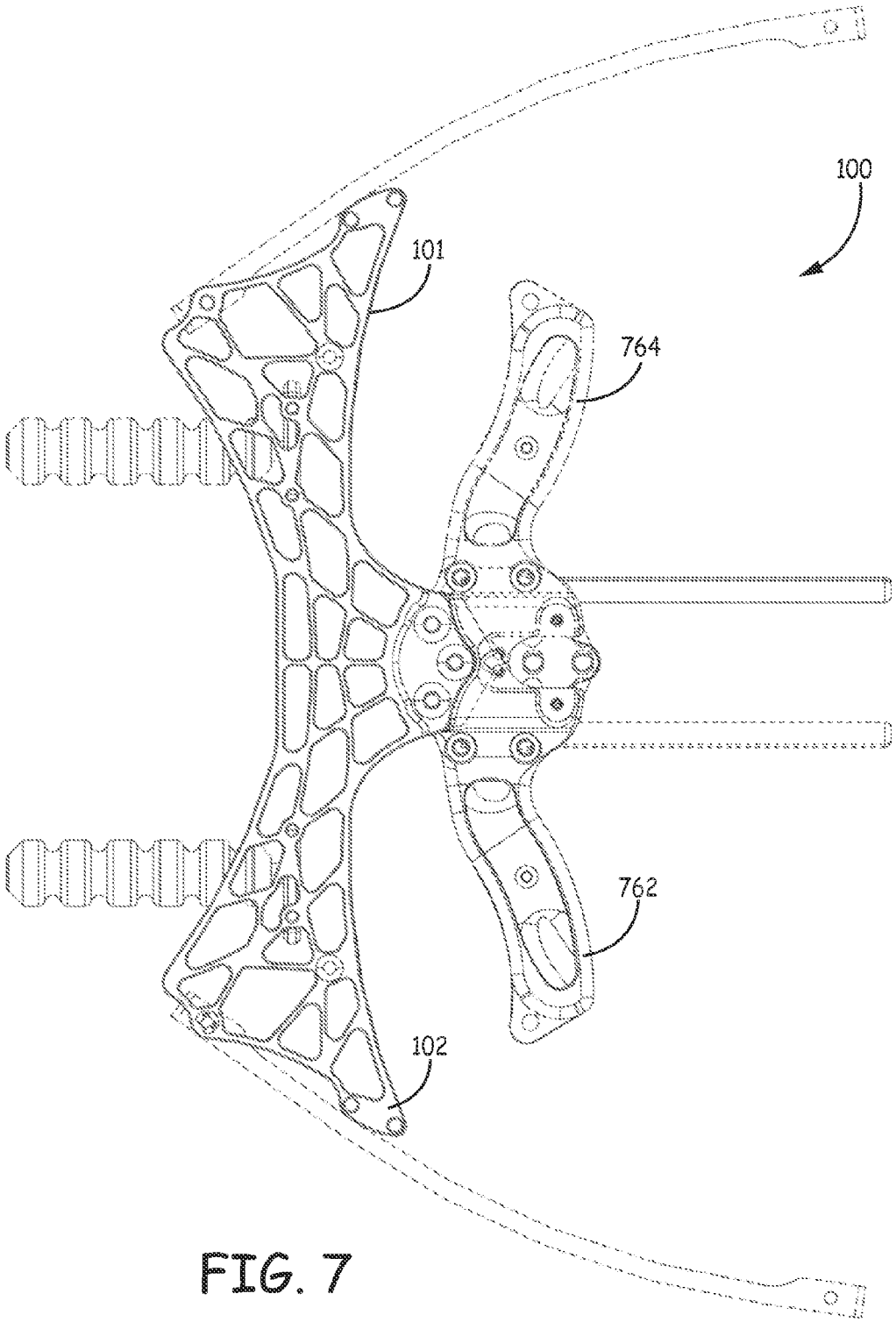
FIG. 7 is a view of a compact compound bow, according to an embodiment.

For comparison FIG. 7 shows a view of the compact compound bow 100 with the handle 132, cable slide, stabilizer mount 140, and stabilizer 140 in both the right handed configuration and the left handed configuration. As seen in FIG. 7, the handle 132 is rotated 180° from the handle's 132 first position 762 for a right handed archer to the handle's 132 second position 764 for a left handed archer. Similarly, the stabilizer mount 140 is coupled to the first position mounting structure 348 when the handle 132 is in the first position 762 and the stabilizer mount 140 is coupled to the second position mounting structure 350 when the handle 132 is in the second position 764.

Figure 8:
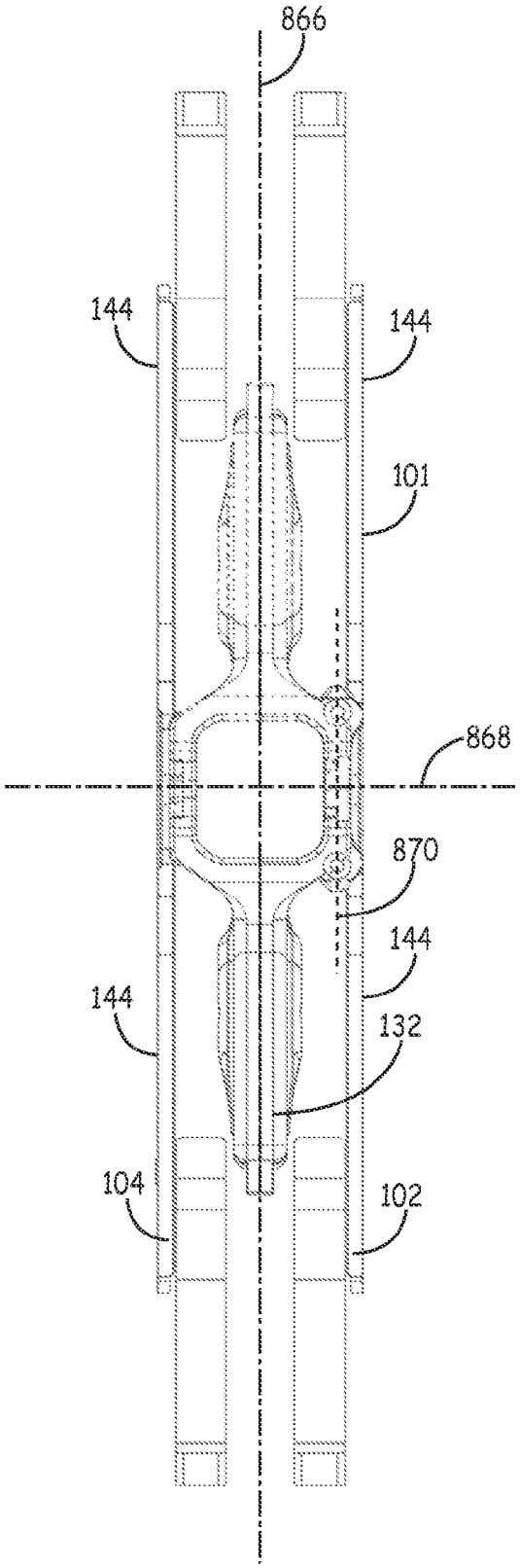
FIG. 8 is a back view of a compact compound bow, according to an embodiment.

For comparison FIG. 8 shows a back view of a portion of the compact compound bow with the handle 132 shown in both the first position 762 and the second position 764. A vertical center plane 866 extends along the middle of the gap 558. A horizontal center plane 868 extends perpendicular to the vertical center plane 866 and through the midpoint of the first and second riser plates 102, 104.

As shown in FIG. 8, two of the locations for the cable slide 136 are located along the same vertical plane 870 relative to the first riser plate 102. The first location of for the cable slide 136 is for the right handed configuration and the second location is for the left handed configuration. The cable slide 136 can be located along the same vertical plane 870 independent of the bow 100 being configured for a right handed archer or a left handed archer.

In an embodiment, the bow 100 can include four sight mount locations 144. In an embodiment, a sight mount 144 can be located to the left of the vertical center plane 866 and above the horizontal center plane 868. In an embodiment, a sight mount 144 can be located to the right of the vertical center plane 866 and above the horizontal center plane 868. In an embodiment, a sight mount 144 can be located to the left of the vertical center plane 866 and below the horizontal center plane 868. In an embodiment, a sight mount 144 can be located to the right of the vertical center plane 866 and below the horizontal center plane 868.

Figure 9:
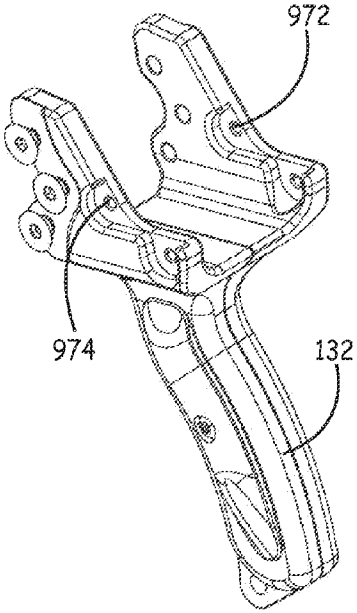
FIG. 9 is a view of a handle for a compact compound bow, according to an embodiment.

FIG. 9 shows a perspective view of a handle 132. The handle 132 can include a first mounting structure 972 configured to accommodate the cable guide 134 when the bow 100 is configured for a right handed archer. The handle 132 can include a second mounting structure 974 configured to accommodate the cable guide 134 when the bow 100 is configured for a left handed archer.

Figure 10:
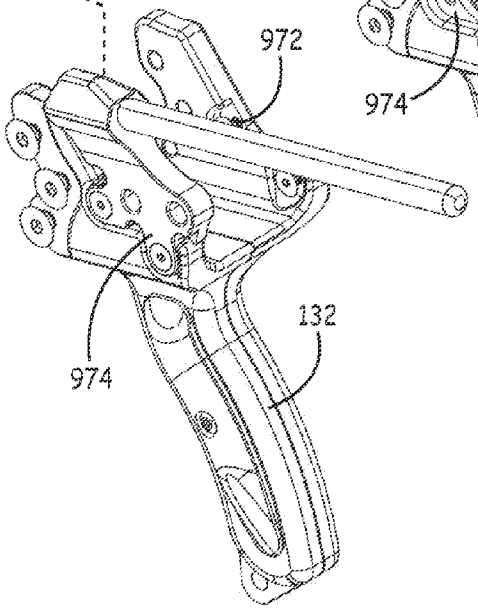
FIG. 10 is a view of a handle for a compact compound bow, according to an embodiment.

FIG. 10 shows a perspective view of the handle 132 with the cable guide 134 coupled to the handle with the first mounting structure 972, such that the handle 132 and cable guide 134 are configured for a right handed archer.

Figure 11:
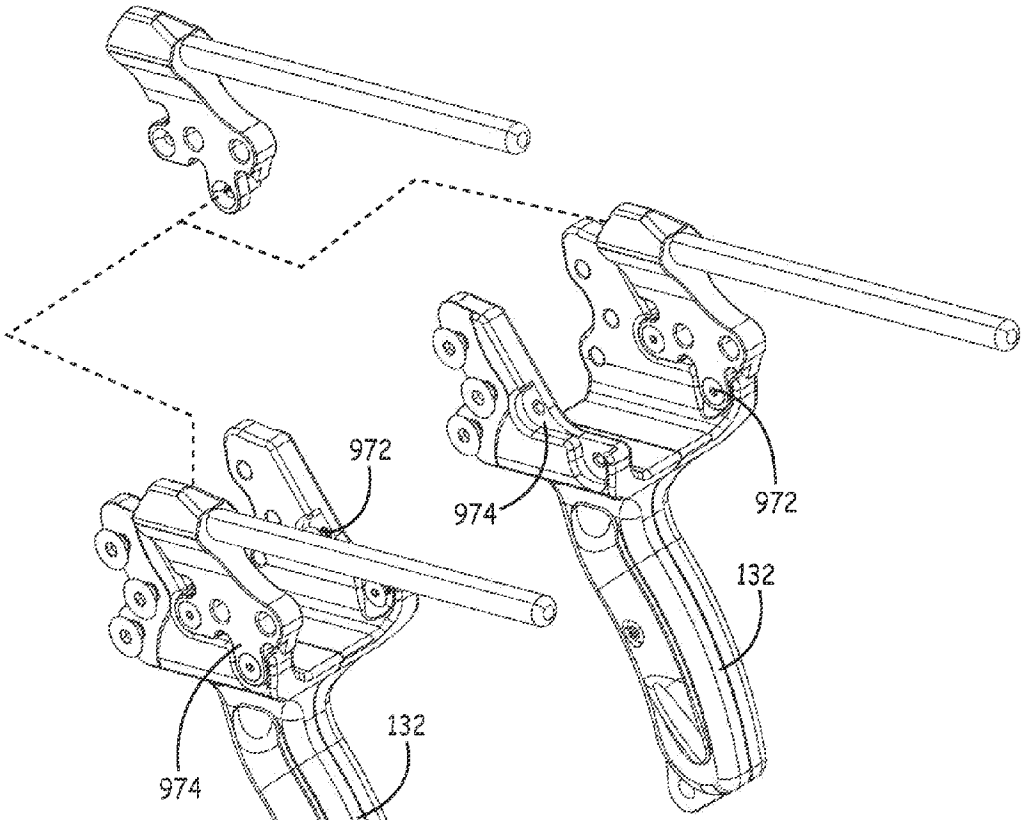
FIG. 11 is a view of a handle for a compact compound bow, according to an embodiment.

FIG. 11 shows a perspective view of the handle 132 with the cable guide 134 coupled to the handle with the second mounting structure 974, such that the handle 132 and cable guide 134 are configured for a left handed archer.

Figure 13:
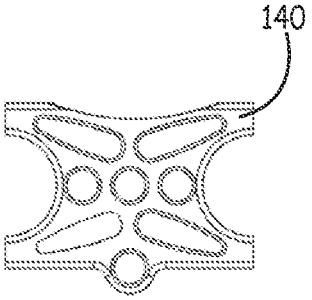
FIG. 13 is a view of a stabilizer bracket, according to an embodiment.
Figure 12:
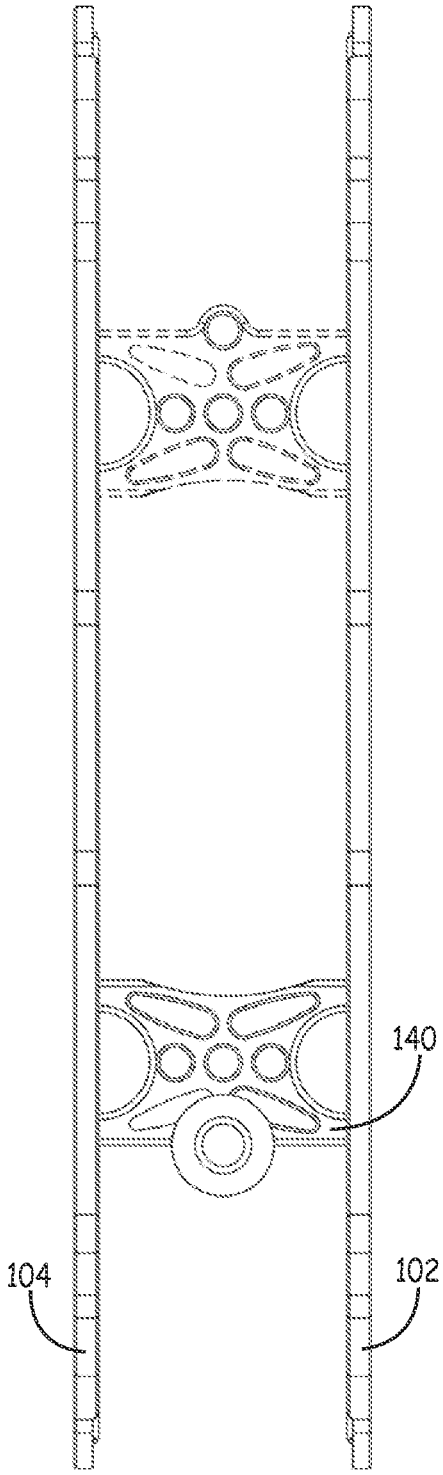
FIG. 12 is a back view of two riser plates and a stabilizer bracket, according to an embodiment.

FIG. 12 is a back view of two riser plates 102, 104 and a stabilizer mount 140, according to an embodiment. The stabilizer mount 140 is shown in two locations, a first location shown in solid lines representative of the stabilizer mount's 140 location when the bow 100 is configured for a right handed archer, and a second location shown in dashed lines representative of the stabilizer mount's 140 location when the bow 100 is configured for a left handed archer. FIG. 13 shows a view of the stabilizer mount 140, according to an embodiment.

Figure 14:
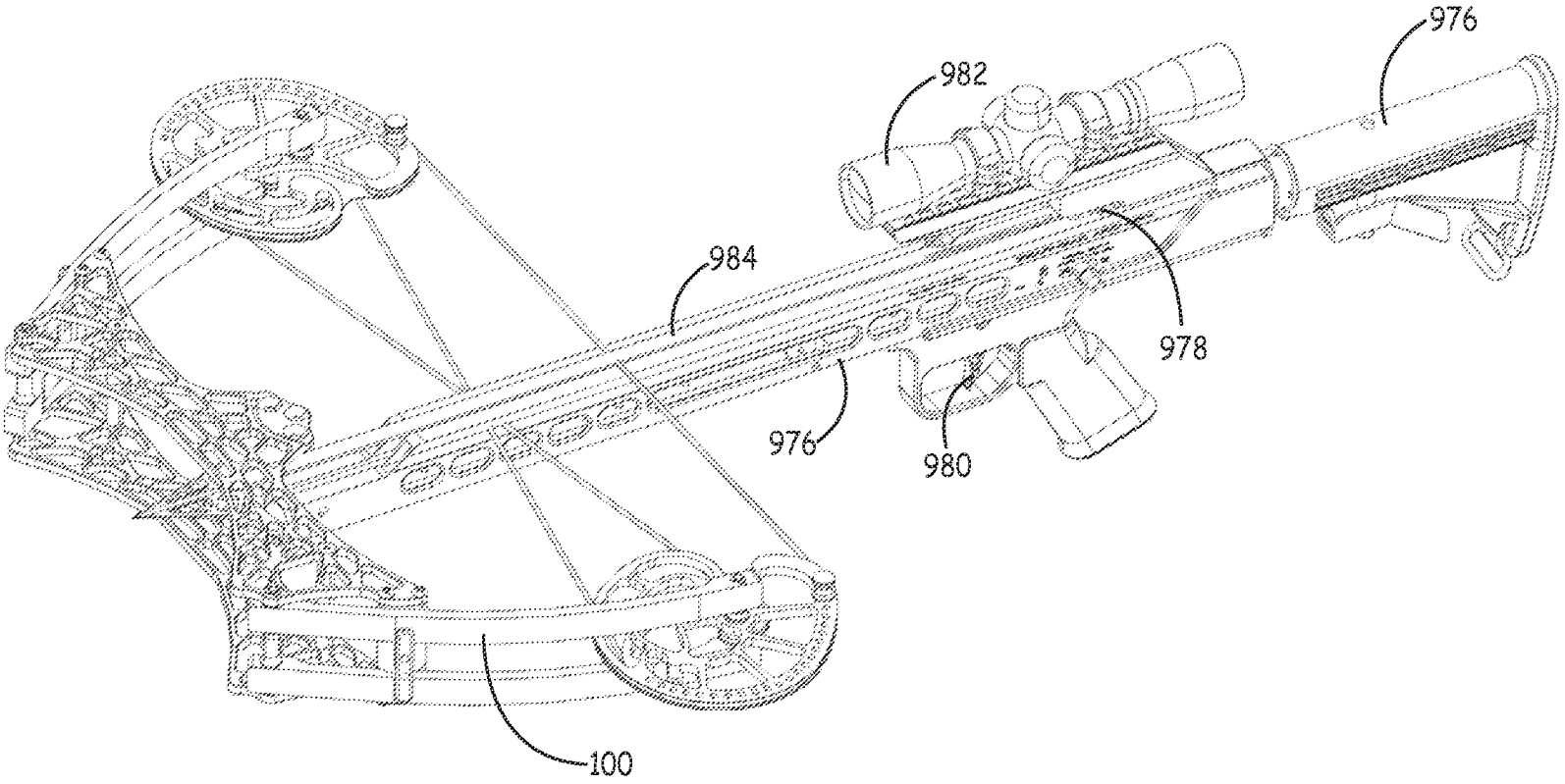
FIG. 14 is a view of a crossbow, according to an embodiment.

FIG. 14 is a view of the bow 100 configured with to be a crossbow, according to an embodiment. The bow 100 can be converted to a cross bow, such as by removing the handle 132 and coupling the bow 100 to a crossbow barrel 976. The crossbow barrel 976 can include a butt stock 976, a string latch means 978, a trigger 980, a sighting means 982, and a bolt 984.

A method can include converting the bow 100 from a right hand configuration to a left hand configuration or alternatively from a left hand configuration to a right hand configuration. In an embodiment, the method can include uncoupling a re-locatable handle from a compound bow. The bow can include a first limb and a second limb coupled to at least one riser plate, a first pulley disposed at the distal end of the first limb, a second pulley disposed at the distal end of the second limb, a drawstring coupled to and extending from the first pulley to the second pulley, at least one cable extending from the first pulley to the second pulley;

In an embodiment, the method can include rotating the re-locatable handle relative to the compound bow between a first position and a second position. The re-locatable handle can include a top end and a bottom end, when the re-locatable handle is in the first position the top end of the handle is towards the first pulley and the bottom end is towards the second pulley, and when the re-locatable handle is in the second position the top end of the handle is towards the second pulley and the bottom end is towards the first pulley. The method can further include coupling the re-locatable handle to the compound bow in the second position. Additionally, the drawstring and cable can be under tension and connected to the compound bow when converting the hand configuration of the compound bow. The bow can be converted from a right (or left) hand configuration to a left (or right) hand configuration without unstringing or reducing the tension of the drawstring and/or cable(s). In some embodiments the bow can be converted without substantially reducing the tension on the cable(s), such that the amount of tension the cables (without a cable guide) are under remains constant. In some embodiments, the bow and method described herein allow for a bow to change from a right hand configuration to a left hand configuration (or left hand configuration to right hand configuration) without removing the drawstring and/or cable(s). The drawstring and cable(s) can also remain at a constant amount of tension without a cable guide. The addition and/or removal of a cable guide can affect the tension of the cable(s); however, the tension of the cables relative to the bow without a cable guide can remain constant throughout the conversion. In an embodiment, the tension of the cables can remain substantially constant throughout the conversion from right handed configuration to left handed configuration (or left handed to right handed), such as by when comparing the tension of the cables without a cable guide. In an embodiment, the bow can be converted from a right (or left) hand configuration to a left (or right) hand configuration without using a bow press to relieve tension on the limbs.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference.

The technology has been described with reference to various specific and preferred embodiments and techniques. However, it should be understood that many variations and modifications may be made while remaining within the spirit and scope of the technology.

The Claims Are:

1. A compound bow, comprising a riser assembly comprising a first riser plate and a second riser plate, wherein the first riser plate and the second riser plate define a gap therebetween;

a first limb and a second limb each coupled to and extending in opposite directions from the riser assembly, wherein at least a portion of the first limb and at least a portion of the second limb are disposed in the gap between the first riser plate and the second riser plate;

a first pulley disposed at a distal end of the first limb;

a second pulley disposed at a distal end of the second limb;

a drawstring extending from the first pulley to the second pulley;

a re-locatable handle coupled to the riser assembly and disposed between the riser assembly and the drawstring, the re-locatable handle comprising a top end and a bottom end, the re-locatable handle configured to be re-locatable from a first, right-handed position to a second, left-handed position; and a cable guide coupled to the re-locatable handle or riser assembly;

wherein the bow is configured to be used in a right-handed configuration and a left handed configuration, wherein when the re-locatable handle is in the first, right-handed position the top end of the handle is towards the first pulley and the bottom end is towards the second pulley, and when the re-locatable handle is in the second, left-handed position the top end of the handle is towards the second pulley and the bottom end is towards the first pulley; and wherein the cable guide is configured to retain one or more cables out of an arrow pathway, wherein the arrow pathway is a pathway of an arrow shot from the compound bow, wherein when the bow in a right-handed configuration the cable guide is positioned to the right of the drawstring, and when the bow in a left-handed configuration the cable guide is positioned to the left of the drawstring.

2. The compound bow of claim 1, wherein the riser assembly defines a sight window between a top of the handle and a bottom of the first or second pulley or a proximal end of the first or second limb, whichever is lower when the compound bow is fully drawn, wherein a height of the sight window is at least 4 inches.

3. The compound bow of claim 1, wherein when in a right-handed configuration all of the cables in their entirety are positioned to the right of the drawstring, and when in a left-handed configuration all of the cables in their entirety are positioned to the left of the drawstring.

4. The compound bow of claim 3, wherein when in a right-handed configuration the cable guide is adjacent to the first riser plate, and when in a left handed configuration the cable guide is adjacent to the first riser plate and in a different location along a vertical axis than when in a right handed configuration.

5. The compound bow of claim 1, wherein the riser assembly defines a first position mounting structure and a second position mounting structure for a stabilizer mount; and wherein the first position mounting structure defines a first plurality of apertures, and the second position mounting structure defines a second plurality of apertures.

6. The compound bow of claim 1, wherein the re-locatable handle is rotated about 180 degrees from the first position to the second position.

7. The compound bow of claim 1, wherein the first limb and second limb are each disposed within the gap defined by the riser assembly.

8. The compound bow of claim 1, wherein the first limb and second limb each comprise a left limb part and a right limb part;

wherein for each of the first limb and second limb, at least one of the left limb part and right limb part and at least a portion of the other limb part are disposed within the gap defined by the riser assembly.

9. The compound bow of claim 1, wherein gap has a width of at least 1.5 inches and not more than 5 inches.

10. The compound bow of claim 1, wherein the drawstring is centered between the first riser plate and the second riser plate.

11. The compound bow of claim 1, wherein the drawstring is along a center plane of the re-locatable handle when the re-locatable handle is in the first or second position.

12. The compound bow of claim 1, wherein the bow can be changed from the right-handed configuration to the left-handed configuration or from the left-handed configuration to the right-handed configuration without unstringing the one or more cables or the drawstring, or without releasing the tension of the one or more cables or the drawstring.

13. The compound bow of claim 1, wherein the first riser plate and the second riser plate are substantially parallel.

14. The compound bow of claim 1, wherein the first riser plate and the second riser plate are substantially similar.

15. The compound bow of claim 1, wherein the first limb and second limb are offset from a vertical center plane of the compound bow to the left or right, and wherein a drawstring is positioned on the vertical center plane of the compound bow.

16. The compound bow of claim 15, wherein the first limb and second limb are offset from the vertical center plane of the compound bow to the right when the bow is in a right-handed configuration, and wherein the first limb and second limb are offset from the vertical center plane of the compound bow to the left when the bow is in a left-handed configuration.

17. The compound bow of claim 1, further comprising:

a D-loop extension coupled to the drawstring, wherein the D-loop extension has a length that is 1.5 inches or greater and is configured to increase a draw length for a user.

18. A compound bow, comprising a riser assembly comprising a first riser plate and a second riser plate, wherein the first riser plate and the second riser plate define a gap therebetween;

a first limb and a second limb each coupled to and extending in opposite directions from the riser assembly, wherein at least a portion of the first limb and at least a portion of the second limb are disposed in the gap between the first riser plate and the second riser plate;

a first pulley disposed at a distal end of the first limb;

a second pulley disposed at a distal end of the second limb;

a drawstring extending from the first pulley to the second pulley;

a re-locatable handle coupled to the riser assembly and disposed between the riser assembly and the drawstring, the re-locatable handle comprising a top end and a bottom end, the re-locatable handle configured to be re-locatable from a first, right-handed position to a second, left-handed position; and a cable guide coupled to the re-locatable handle or riser assembly;

wherein the bow is configured to be used in a right-handed configuration and a left handed configuration, wherein when the re-locatable handle is in the first, right-handed position the top end of the handle is towards the first pulley and the bottom end is towards the second pulley, and when the re-locatable handle is in the second, left-handed position the top end of the handle is towards the second pulley and the bottom end is towards the first pulley; and wherein the cable guide is configured to retain one or more cables out of an arrow pathway, wherein the arrow pathway is a pathway of an arrow shot from the compound bow, wherein when the bow in a right-handed configuration the cable guide is positioned to the right of the drawstring, and when the bow in a left-handed configuration the cable guide is positioned to the left of the drawstring, wherein the first plate and the second plate have a thickness of at least 0.05 inches and not more than 1 inch.

19. The compound bow of claim 18, wherein the thickness of the first plate and the second plate is at least 0.05 inches and not more than 0.25 inches.

20. The compound bow of claim 18, wherein when the bow is in a right-handed configuration a center of each limb is offset to the right of a center of the gap, and when in a left-handed configuration a center of each limb is offset to the left of a center of the gap.

21. The compound bow of claim 18, wherein the bow can be changed from the right-handed configuration to the left-handed configuration or from the left-handed configuration to the right-handed configuration without unstringing the one or more cables or the drawstring, or without releasing the tension of the one or more cables or the drawstring.

22. A compound bow, comprising a riser assembly comprising a first riser plate and a second riser plate, wherein the first riser plate and the second riser plate define a gap therebetween;

a first limb and a second limb each coupled to and extending in opposite directions from the riser assembly, wherein at least a portion of the first limb and at least a portion of the second limb are disposed in the gap between the first riser plate and the second riser plate;

a first pulley disposed at a distal end of the first limb;

a second pulley disposed at a distal end of the second limb;

a drawstring extending from the first pulley to the second pulley;

a re-locatable handle coupled to the riser assembly and disposed between the riser assembly and the drawstring, the re-locatable handle comprising a top end and a bottom end, the re-locatable handle configured to be re-locatable from a first, right-handed position to a second, left-handed position; and a cable guide coupled to the re-locatable handle or riser assembly;

wherein the bow is configured to be used in a right-handed configuration and a left handed configuration, wherein when the re-locatable handle is in the first, right-handed position the top end of the handle is towards the first pulley and the bottom end is towards the second pulley, and when the re-locatable handle is in the second, left-handed position the top end of the handle is towards the second pulley and the bottom end is towards the first pulley; and wherein the cable guide is configured to retain one or more cables out of an arrow pathway, wherein the arrow pathway is a pathway of an arrow shot from the compound bow, wherein when the bow in a right-handed configuration the cable guide is positioned to the right of the drawstring, and when the bow in a left-handed configuration the cable guide is positioned to the left of the drawstring, wherein a distance between an axle of the first pulley and an axle of the second pulley is no greater than 24 inches in a resting position.

23. The compound bow of claim 22, wherein the riser assembly defines a sight window between a top of the handle and a bottom of the first or second pulley or a proximal end of the first or second limb, whichever is lower when the compound bow is fully drawn, wherein a height of the sight window is at least 4 inches.

24. The compound bow of claim 22, wherein the first plate and the second plate have a thickness of at least 0.05 inches and not more than 1 inch.

25. The compound bow of claim 22, wherein the first limb and second limb are offset from a vertical center plane of the compound bow to the left or right, and wherein a drawstring is positioned on the vertical center plane of the compound bow.

26. The compound bow of claim 25, wherein the bow can be changed from the right-handed configuration to the left-handed configuration or from the left-handed configuration to the right-handed configuration without unstringing the one or more cables or the drawstring, or without releasing the tension of the one or more cables or the drawstring.

27. A compound bow, comprising a riser assembly comprising a first riser plate and a second riser plate, wherein the first riser plate and the second riser plate define a gap therebetween;

a first limb and a second limb each coupled to and extending in opposite directions from the riser assembly, wherein at least a portion of the first limb and at least a portion of the second limb are disposed in the gap between the first riser plate and the second riser plate;

a first pulley disposed at a distal end of the first limb;

a second pulley disposed at a distal end of the second limb;

a drawstring extending from the first pulley to the second pulley;

a re-locatable handle coupled to the riser assembly and disposed between the riser assembly and the drawstring, the re-locatable handle comprising a top end and a bottom end, the re-locatable handle configured to be re-locatable from a first, right-handed position to a second, left-handed position; and a cable guide coupled to the re-locatable handle or riser assembly;

wherein the bow is configured to be used in a right-handed configuration and a left handed configuration, wherein when the re-locatable handle is in the first, right-handed position the top end of the handle is towards the first pulley and the bottom end is towards the second pulley, and when the re-locatable handle is in the second, left-handed position the top end of the handle is towards the second pulley and the bottom end is towards the first pulley; and wherein the cable guide is configured to retain one or more cables out of an arrow pathway, wherein the arrow pathway is a pathway of an arrow shot from the compound bow, wherein when the bow in a right-handed configuration the cable guide is positioned to the right of the drawstring, and when the bow in a left-handed configuration the cable guide is positioned to the left of the drawstring, wherein the bow can be changed from the right-handed configuration to the left-handed configuration or from the left-handed configuration to the right-handed configuration without unstringing the one or more cables or the drawstring, or without releasing the tension of the one or more cables or the drawstring.

28. The compound bow of claim 27, wherein a distance between an axle of the first pulley and an axle of the second pulley is no greater than 24 inches in a resting position.

29. The compound bow of claim 27, wherein the first plate and the second plate have a thickness of at least 0.05 inches and not more than 1 inch.

30. The compound bow of claim 27, wherein the first limb and second limb are offset from a vertical center plane of the compound bow to the left or right, and wherein a drawstring is positioned on the vertical center plane of the compound bow.

* * * * *